US007619156B2

(12) United States Patent
Haken

(10) Patent No.: US 7,619,156 B2
(45) Date of Patent: Nov. 17, 2009

(54) POSITION CORRECTION FOR AN ELECTRONIC MUSICAL INSTRUMENT

(76) Inventor: Lippold Haken, 1906 Augusta Dr., Champaign, IL (US) 61821

( * ) Notice: Subject to any disclaimer, the term of this patent is extended or adjusted under 35 U.S.C. 154(b) by 79 days.

(21) Appl. No.: 11/251,443

(22) Filed: Oct. 15, 2005

(65) Prior Publication Data

US 2007/0084331 A1 Apr. 19, 2007

(51) Int. Cl.
*G10H 1/22* (2006.01)

(52) U.S. Cl. ..... 84/618

(58) Field of Classification Search ..... 84/618, 84/656, 684, 615, 653, 678, 742, 442, 443, 84/444, 619, 657, 685, 445, 470
See application file for complete search history.

(56) References Cited

U.S. PATENT DOCUMENTS

| | | | | |
|---|---|---|---|---|
| 3,626,350 | A | 12/1971 | Suzuki et al. | |
| 4,341,141 | A | 7/1982 | Deutsch et al. | |
| 4,384,503 | A | 5/1983 | Gunn | |
| 4,480,519 | A * | 11/1984 | Allen | 84/615 |
| 4,558,623 | A | 12/1985 | Buchla | |
| 4,810,992 | A | 3/1989 | Eventoff | |
| 4,972,752 | A | 11/1990 | Van Duyne | |
| 5,008,497 | A | 4/1991 | Asher | |
| 5,079,536 | A | 1/1992 | Chapman | |
| 5,350,883 | A * | 9/1994 | Kitamura et al. | 84/644 |
| 5,398,585 | A | 3/1995 | Starr | |
| 5,619,003 | A | 4/1997 | Hotz | |
| 5,741,990 | A | 4/1998 | Davies | |
| 5,917,180 | A | 6/1999 | Reimer et al. | |
| 6,107,559 | A * | 8/2000 | Weinstock et al. | 84/634 |
| 6,121,534 | A * | 9/2000 | Brush | 84/617 |
| 6,703,552 | B2 * | 3/2004 | Haken | 84/658 |

OTHER PUBLICATIONS

Haken, Lippold, Ed Tellman, Patrick Wolfe. "An Indiscrete Music Keyboard." Computer Music Journal, vol. 22, No. 1 (Spring, 1998), pp. 30-48.*

Antares Auto Tune Software. <http://web.archive.org/web/20040803204728/http://www.proaudiomusic.com/software/antares/antares.htm>. Aug. 3, 2004.*

DC Music, "Antares Really Cool Stuff for Making Music," 8 pp., http://www.proaudiomusic.com/software/antares/antares.htm, Aug. 25, 2006.

Sound On Sound: The World's Best Music Recording Magazine, "Automagic Alternative Uses for Auto-Tune," 4 pp., http://www.soundonsound.com/sos/aug99/articles/autotune.htm, Aug. 1999.

(Continued)

*Primary Examiner*—Jeffrey Donels
*Assistant Examiner*—Andrew R Millikin
(74) *Attorney, Agent, or Firm*—Brinks Hofer Gilson & Lione

(57) ABSTRACT

A system and method for correction of finger positions for an electronic musical instrument. By adding a correction step in the direction of a nearest grid value, the system can perform correction in a manner that allows for gradual position correction while maintaining a vibrato or glissando shape that is similar to vibrato or glissando shape of the actual finger positions over time. The system and method may be used for pitch correction for a continuous-pitch electronic musical instrument.

23 Claims, 5 Drawing Sheets

OTHER PUBLICATIONS

Doepfer Musikelektronik, "R2M Midi Ribbon Controller," 4 pp., http://www.doepfer.de/R2M.htm, Aug. 25, 2006.

R. Moog, "A Multiply Touch-Sensitive Clavier for Computer Music," Proc. 1982 Int. Computer Music Conf., Int. Computer Music Assoc., San Francisco, pp. 155-159, 1982.

J. M. Snell, "Sensors for Playing Computer Music with Expression," Proc. 1983 Int. Computer Music Conf., Int. Computer Music Assoc., San Francisco, pp. 113-126, 1983.

D. Keislar, "History and Principles of Microtonal Keyboards," Computer Music J., vol. 11, No. 1, pp. 18-28, 1987.

H. Fortuin, "The Clavette: A Generalized Microtonal MIDI Keyboard Controller," Proc. 1995 Int. Computer Music Conf., Int. Computer Music Assoc., San Francisco, p. 223, 1995.

E. Johnstone, "The Rolky: A Poly-Touch Controller for Electronic Music," Proc. 1985 Int. Computer Music Conf., Int. Computer Music Assoc., San Francisco, pp. 291-295, 1985.

L. Haken, R. Abdullah, and M. Smart, "The Continuum: A Continuous Music Keyboard," CERL Sound Group, Electrical and Computer Engineering, University of Illinois, Urbana, Illinois, 61801.

L. Haken, K. Fitz, E. Tellman, P. Wolfe, and P. Christensen, "A Continuous Music Keyboard Controlling Polyphonic Morphing Using Bandwidth-Enhanced Oscillators," CERL Sound Group, University of Illinois, http://datura.cerl.uiuc.edu.

* cited by examiner

POSITION CORRECTION FOR AN ELECTRONIC MUSICAL INSTRUMENT

BACKGROUND

1. Technical Field

The invention generally relates to electronic music controllers, and more particularly to position correction for electronic musical instruments.

2. Related Art

Continuous-pitch electronic controllers are a promising alternative to traditional electronic music keyboards for controlling music synthesizers. Continuous-pitch controllers allow the musician to use any tuning system, to play vibrato and smooth glissandi, to play blue notes, and to perform many other expressive actions not possible on a traditional music keyboard. A variety of continuous-pitch electronic controllers are commercially available. Monophonic controllers include MIDI Theremins, MIDI ribbon controllers, and the KYMA-WACOM controller. Polyphonic controllers include the Tactex Multitouch and the Haken Audio™ Continuum™ Fingerboard. The Continuum™ Fingerboard is discussed in U.S. Pat. No. 6,703,552, which is incorporated herein by reference. Experimental controllers include the Fretless MIDI Guitar and the MIDI Trombone.

Continuous-pitch controllers rely on a skilled musician that has developed precise positioning techniques. Precise positioning of either the hand (for the Theremin), finger (for ribbon controllers, the Tactex controller, the Continuum™ Fingerboard, and the Fretless MIDI Guitar), pen (for KYMA-WACOM), or slide (MIDI Trombone) is essential for a good performance. As used herein, "finger" should be understood to mean a hand finger, pen, slide, or other control mechanism used to identify a position that corresponds to a desired musical parameter. "Finger position" is a position on the playing surface of the electronic music instrument or controller. For example, the finger position may identify a pressure focal point on a Continuum™ Fingerboard and may correspond to a desired pitch. "Finger position data" should be understood to mean data that identifies a finger position.

Continuous-pitch instruments provide new possibilities for the performing musician, but also present added difficulties. The musician must precisely place fingers for an in-tune performance. This can be challenging, especially for polyphonic controllers, which must address several notes played at once. Not only must each finger be placed in the exact position at the beginning of each note; each finger must be in exact position after glissandi and other finger movements are performed. If the continuous controller has an octave spacing comparable to a traditional music keyboard, finger positions must be accurate to a fraction of a millimeter (3 to 5 cents) to satisfy a sophisticated listener.

Accordingly, it is desirable to include pitch correction in the controller. A variety of methods exist for modify the pitch of notes in audio recordings. For example, an audio waveform may be analyzed and modified to change the frequency of the fundamental and harmonics of a note. This is technically challenging, however, and existing algorithms have a varying degree of success dealing with polyphony, reverb, and timbre artifacts introduced in changing the waveform.

Alternatively, one can correct finger position, instead of waveform. In this manner, correction can be accomplished before a waveform is generated. One method is to round the value to correspond with the nearest MIDI key number. Simple rounding to the next MIDI key number, however, transforms the continuous pitch instrument into a discrete pitch instrument. Accordingly, devices using such a method are not able to perform vibrato, smooth glissandi, or any of the other small variations in pitch.

Further developments have implemented finger position correction in which the initial finger position is rounded to the nearest MIDI key number, and then pitch changes are tracked from that position. Such a feature has been available in the Haken Audio™ Continuum™ Fingerboard since 2001.

As one advantage of continuous pitch devices is the incorporation of smooth glissando and/or vibrato, it would be beneficial to implement a controller, continuous-pitch or otherwise, that will correct finger positions continually, i.e. not only at the beginning of a note, and will allow for glissando and vibrato.

BRIEF SUMMARY

By way of introduction, the preferred embodiments described below include a method and system for correcting and outputting pitch through analysis and correction of finger positions placed on a musical instrument. These embodiments correct finger position both in the initial placement stage and after finger position movement, such as glissando or vibrato, is performed. Although the preferred embodiments correction finger positions that correspond to musical pitches, the invention encompasses finger position correction that can correspond to any desired attribute.

Accordingly, a musician can place fingers with positional errors, and still hear a note or chord that corresponds with more accurate finger placement. The musician may then slide fingers to new positions; the new finger positions will also be corrected.

Precisely correct pitches correspond to certain finger positions. These fixed positions form a grid, which may be spaced evenly or unevenly. In one embodiment, the grid may be based on the equal-tempered music scale incorporating twelve equally-spaced half-steps (C, C#, D, D#, E, F, F#, G, G#, A, A#, and B). Alternatively, other implementations of the present invention may utilize other tuning systems by changing the grid definitions. For example, grid definitions may be based on just-intonation scales. In one embodiment, the musician may switch tuning systems by altering the grid definitions during a performance.

The controller receives actual finger position data and outputs corrected finger position data. When the controller receives a new iteration of finger position data, the change in actual finger positions is computed by comparing the new actual finger positions are compared with the previous iteration's actual finger positions. The change in actual finger position are then added to the previous corrected finger positions, and these values are compared with the locations of the grid. Correction steps are then added to create new corrected finger positions. The process then repeats in subsequent iterations.

The operation of this implementation for each finger may be expressed using the following nomenclature:

$AFP_X$=Actual Finger Position at time X $CFP_X$=Corrected Finger Position at time X $\Delta_X$=Finger Position Differential ($AFP_X - AFP_{X-1}$) at time X CS=Correction Step In the initial state, i.e. the first measured finger placement, there is no Finger Position Differential. Instead, $CFP_1$ is set to equal $AFP_1$. Alternatively, initial position correction may be implemented such that $CFP_1$ is equal to the nearest grid position in the currently selected grid, or is equal to the actual finger position ($AFP_1$) plus a correction step. In the initial state, there is no finger position differential ($\Delta_1$).

At time t=2, a second actual finger position, $AFP_2$, is measured. The finger position differential is then calculated by comparing the second actual finger position with the first actual finger position, i.e., $\Delta_2=AFP_2-AFP_1$. Next, the closest grid position to $CFP_1+\Delta_2$ is assessed. The corrected finger position at time 2 is then computed by applying a correction step (CS) to the sum of the corrected finger position of time 1 and the finger position differential at time 2. Accordingly, $CFP_2=CFP_1+\Delta_2\pm CS$. The iterative process then repeats such that $CFP_3=CFP_2+\Delta_3\pm CS$, $CFP_4=CFP_3+\Delta_4\pm CS$, . . . , $CFP_{n-1}=CFP_{n-2}+\Delta_{n-1}\pm CS$, $CFP_n=CFP_{n-1}+\Delta_n\pm CS$. When $CFP_n$ is within a correction step (CS) of the nearest grid position, it is set to that nearest grid position.

The correction step (CS) enables pitch correction to occur over a series of iterations. Because hundreds of iterations may occur in a second, the pitch correction may be implemented in a smooth manner that is pleasing to a listener's ear.

Embodiments of the invention may utilize difference sizes of correction steps. Such correction sizes may either be preset or may be adjusted during play by the musician. A smaller correction size will result in smaller corrections over time, and thus a slower progression to the correct pitch. A larger correction size will result in larger corrections, and thus a faster progression to the correct pitch. In this regard, the musician can control the rate at which finger position correction is performed.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
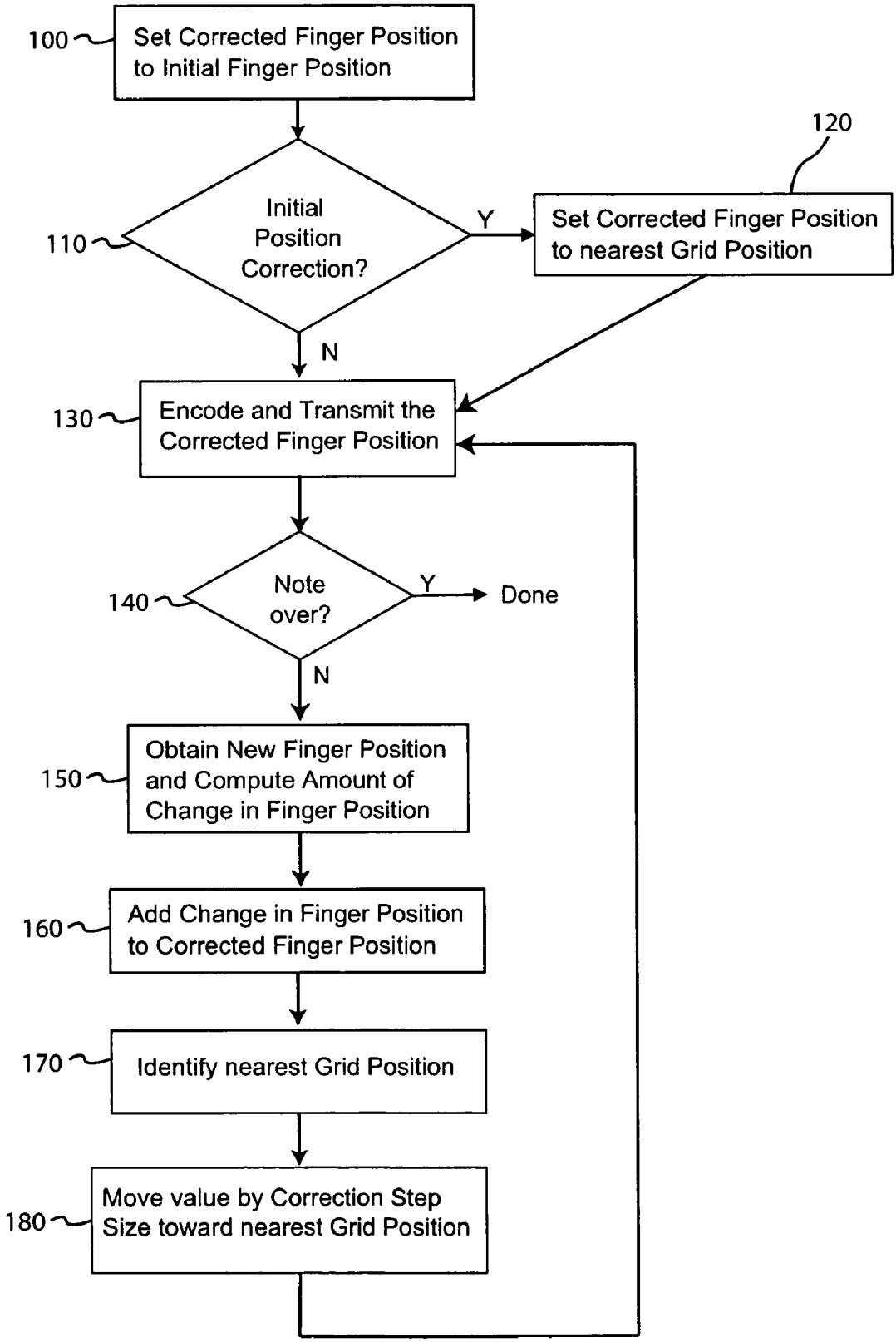
FIG. 1 is a flow chart of a method of correcting finger position data.

As shown in FIG. 1, a method of finger position correction is depicted. For ease of explanation, the method shows an iterative correction of a single finger position. In polyphonic operation, multiple instances of this method are evaluated to process multiple finger positions. In step 100, the corrected finger position is set to the musician's actual initial finger position on a playing surface. In step 110, the system will check if initial position correction is desired. If initial position correction is not desired, the method proceeds to step 130. If it is desired, the system will set the corrected finger position to the nearest grid position in the currently selected grid in step 120.

In a typical embodiment, an equal-tempered twelve half-step tuning is utilized. In this regard, the grid may be set to multiples of 100 cents. A cents value of 6000 corresponds to a musical pitch middle C, a cents value of 6100 is a middle C sharp, and so on. Alternatively, any conceivable turning may be used in a grid. Tuning modifications may be implemented through an input device, such that a musician could change tunings before, after, or during a performance. The input device may be a foot pedal, dial, slider, computer, etc.

In step 130, the corrected finger position is encoded. In one preferred embodiment, the finger positions are encoded in MIDI (Musical Instrument Digital Interface) format. Because MIDI is designed to allow for control over pitch, volume levels, and timbre, it presents a preferred means of translating finger positions generated on a playing surface. Nonetheless, alternative embodiments may be implemented in which any other language is utilized.

Next, the MIDI data (or other appropriate pitch representative signal) is then sent to a synthesizer for conversion into an audio signal. Such an audio signal is then audible by a listener, who can hear the corrected pitch. If necessary, an amplifier or pre-amplifier may be introduced to raise the volume, equalize the frequency spectrum, or introduce other effects to the audio signal.

In step 140, the system detects whether a finger has been lifted. If the finger has been lifted, the note is deemed to be over and the process concludes. If the finger has not been lifted, the system proceeds to step 150.

A new finger position is obtained and the difference in the change in finger position is computed in step 150. Using the previously presented nomenclature, this differential may be represented as $\Delta_n=AFP_n-AFP_{n-1}$, where $AFP_n$ is the new finger position obtained and $AFP_{n-1}$ is the previous actual finger position.

In step 160, the differential, $\Delta_n$, is added to the previously presented finger position, $CFP_{n-1}$. The nearest grid position to this value is then identified in step 170. The nearest grid position may be also identified with respect to the current actual finger position $AFP_n$, previous actual finger positions, or previous corrected finger positions.

Next, in step 180, a correction step in the direction of the nearest grid position is added to the $CFP_{n-1}+\Delta_n$ value. Accordingly, if the nearest grid position is lower in pitch, the correction step would be applied negatively, i.e. subtracted from the $CFP_{n-1}+\Delta_n$. If the nearest grid position is greater in pitch, the correction step value would be added to the $CFP_{n-1}+\Delta_n$. If the nearest grid position is within a correction step of $CFP_{n-1}+\Delta_n$, then $CFP_n$ is set to that nearest grid position. The new corrected finger position is thus identified and the process then repeats by encoding and transmitting this corrected finger position in step 130.

As used herein, "correction step" is any value that when applied to one or more finger position data values yields at least one new value that is closer, or is among of set of values that are on the average closer, to a grid position. "Applying a correction step" may encompass adding or subtracting a value, multiplying or dividing by value, or any other mathematical operation that will yield at least one new value. The correction step may be a constant, a variable that may be adjusted by the user, a percentage of a difference between a grid position and a finger position data value, a function of past finger position values, a function of past finger position data values and past correction step values, or any other value applied to yield a new corrected finger position.

In one embodiment in which pitch correction is desired, the correction step may be performed every 5 milliseconds with a correction step size of one cent (one cent is $1/100^{th}$ of an equal-tempered musical half-step). At this setting, a slow correction occurs over several iterations. In this manner, the overall dynamic of the musician's performance remains intact, while the pitch is corrected. Alternatively other correction cycles and step sizes may be utilized. For example, the correction step may be performed every 1⅓ milliseconds with a correction step size of one-tenth of a cent.

It is preferable for the correction step sizes to be smaller than two adjacent grid positions. For an equal-tempered musical scale, the grid positions would evenly spaced and thus it is irrelevant which two adjacent grid positions are examined. Alternatively, the grid positions may be unevenly spaced. It would be a manner of design choice whether two specific grid positions are examined to determine the correction step size or desired range of correction step sizes, or whether correction step sizes are determined dynamically by identifying grid positions that are proximate to one or more actual and/or corrected finger positions.

If the correction step size is increased, the pitch correction occurs more abruptly. With a greatly increased correction step size, the musician could effectively emulate a piano-style glissando from a continuous playing surface. In this manner, the glissando would proceed with discrete pitch steps as opposed to a smooth continuous-pitch glissando, and vibrato will be eliminated.

If correction step size is decreased, the pitch correction is slower. Here, vibrato and glissando will be affected to a lesser degree and it will take longer to get to the correct pitch. Accordingly, an extremely small correction step size could perform correction at such a slow rate that a listener could hear that a note is out of tune.

Accordingly in one embodiment, the correction step size may be increased or decreased before, after, or during a musical performance. This adjustment may be controlled by a variety of input devices, such as a foot pedal, dial, slider, or computer. In this manner, a musician can adjust the trade off between quicker position correction and maintaining vibrato and/or glissando to his or her liking.

Alternatively, the correction step size may be preset and unmodifiable, or set to be modified only at specific times. For example, a correction step size of one cent has been determined to be appropriate for enabling pitch correction at a fast enough speed that the adjustment is not appreciable by a listener while keeping the vibrato and/or glissando dynamics of the musician's performance.

Figure 2:
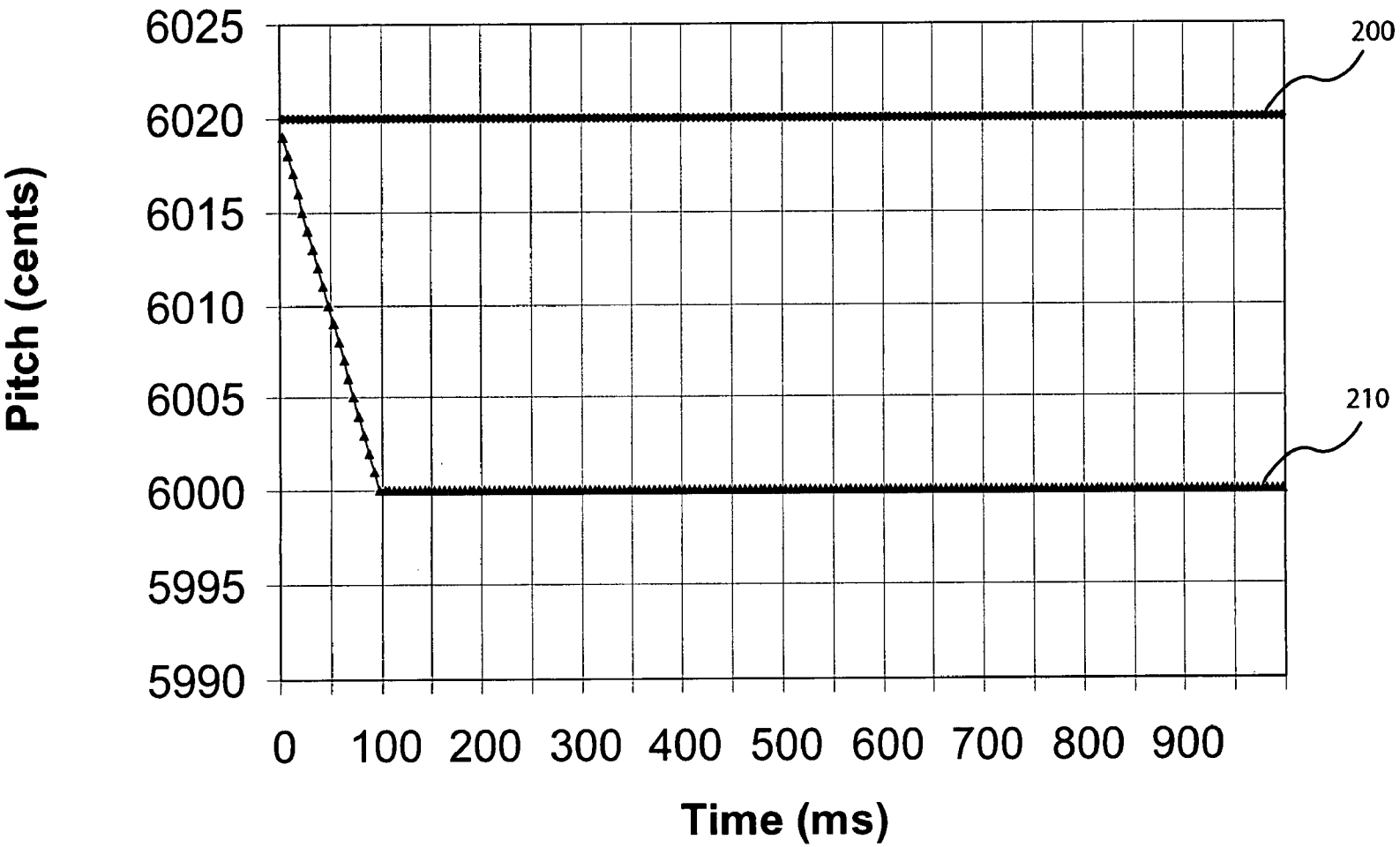
FIG. 2 is a graph depicting pitch correction for a note without glissando or vibrato in accordance with an embodiment of the present invention.
Figure 3:
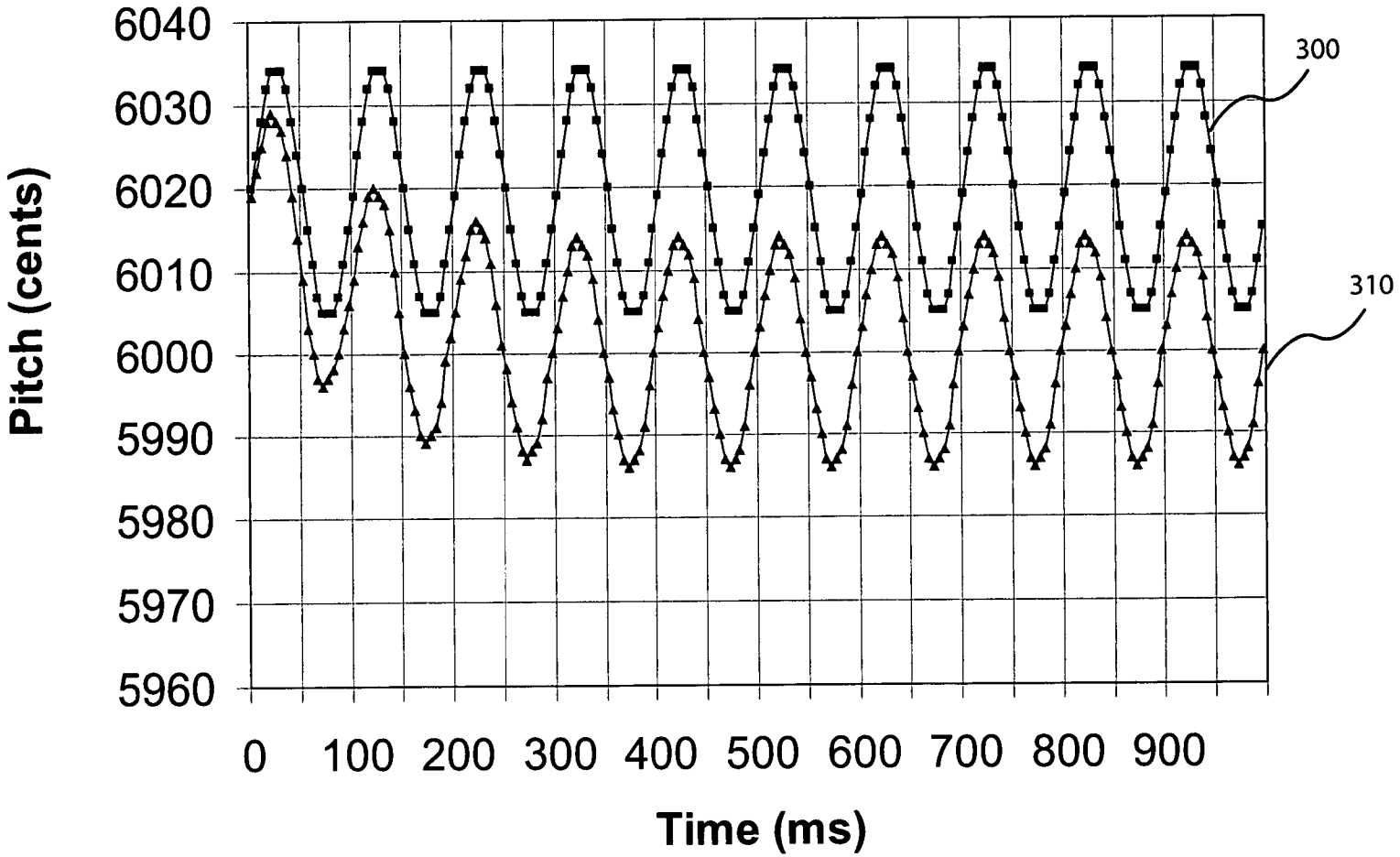
FIG. 3 is a graph depicting pitch correction for a note with vibrato in accordance with an embodiment of the present invention.
Figure 4:
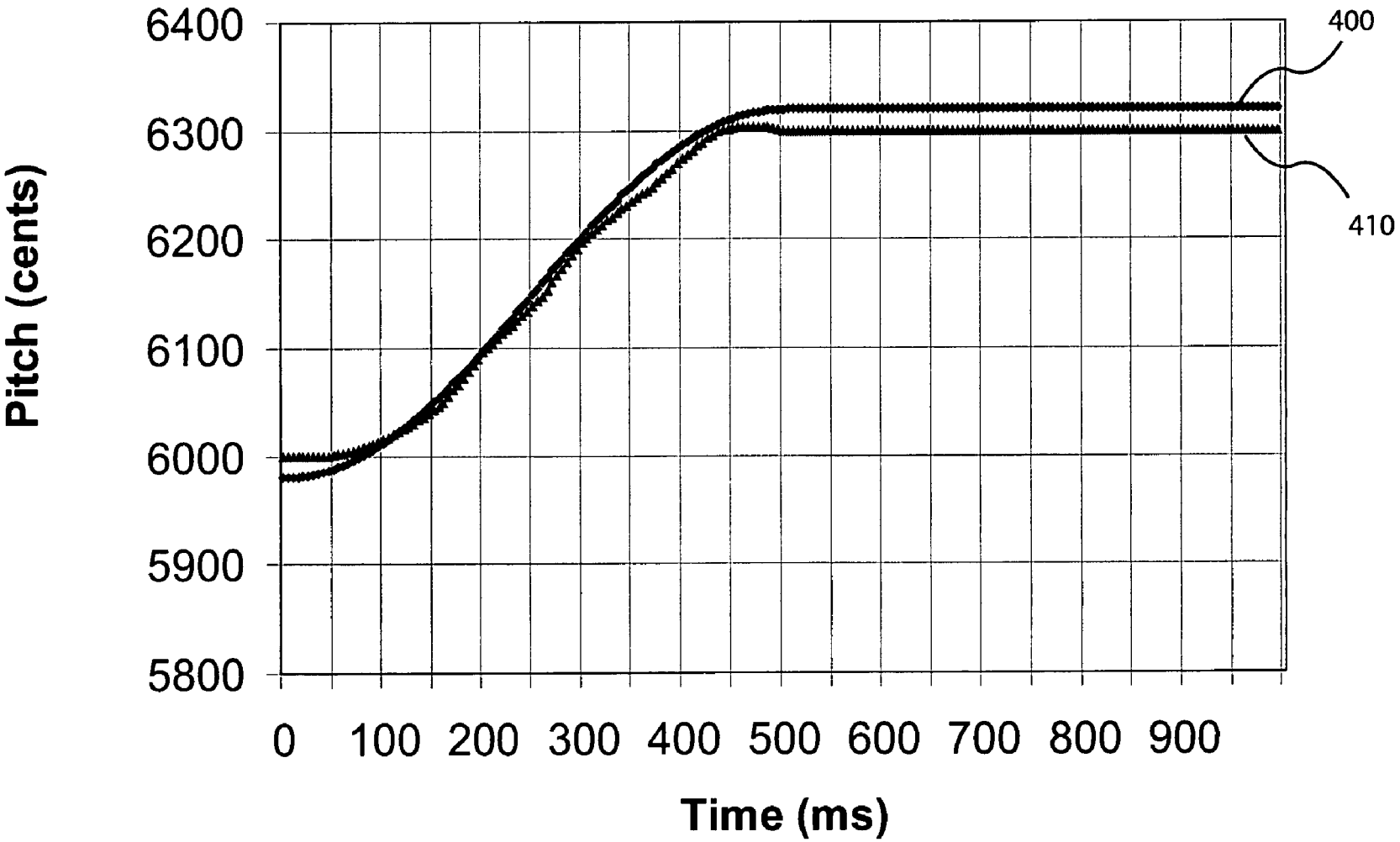
FIG. 4 is a graph depicting pitch correction for a note with glissando in accordance with an embodiment of the present invention.

FIGS. 2, 3 and 4 graphically depict the operation of an embodiment in which finger positions that correspond to desired musical pitches are corrected. In this embodiment, the correction step size is set at 1 cent, data points are taken and analyzed every 5 milliseconds, and the grid values are set for equal-tempered twelve half-step tuning with grid values at multiples of 100 cents. Initial position correction is disabled. For ease of explanation, only one note is shown in the graphs. In real-time play, however, multiple notes may be pitch corrected in real-time.

As shown in FIG. 2, element 200, a musician has placed a finger position on the playing surface that corresponds to 6020 cents. This pitch is slightly sharp of middle C. The musician's actual finger position (line 200) remains unchanged. Accordingly, neither vibrato nor glissando is present. With the correction step size set at 1 cent and new data points taken and corrected pitches outputted every 5 milliseconds, the corrected finger position (line 210) reaches the correct pitch of 6000 cents in 0.1 seconds. Because the actual finger position 200 is unchanged, the corrected finger position 210 remains unchanged at the correct pitch of 6000 cents after 100 milliseconds.

FIG. 3, depicts an instance in which the musician is playing with vibrato. The actual finger position 300 moves sinusoidally up and down with an amplitude of about 35 cents approximately once every 100 milliseconds. For vibrato that is occurring in correct pitch, the finger position should be centered over 6000 cents. In FIG. 3, the actual finger position is centered at 6020 cents, again slightly sharp.

With the correction step size set at 1 cent, the correction at any given iteration is significantly less than the peak-to-peak variation of 30 cents that repeated occurs in the actual finger position 300. Because of this difference of scale, the corrected finger position 310 will gradually "creep" toward the correct pitch and will have a similar vibrato shape as the actual finger position 300. In other words, the correction step size is smaller than the dynamic range of the "wobbling" that occurs in finger position. In this manner, the pitch correction is less harsh and more true to the musician's intentions, while providing corrected finger positions that are accurate enough to satisfy even a sophisticated listener. As show in FIG. 3, the corrected pitch is reached in about 300 milliseconds.

The correction step size allows for a trade-off between distortion of the vibrato shape of actual finger position 300 and the outputted corrected finger position 310. As shown in FIG. 3, there is a slight alteration in the vibrato shape of the corrected finger position 310 as compared with the actual finger position 300. This slight variation is generally not noticeable by even a sophisticated listener. If simultaneous notes are played without vibrato, listeners can hear pitch extremely precisely by listening to beats between notes. Where notes are played with vibrato, some of the same psychoacoustic cues are not available and listeners cannot discern pitch so precisely. Accordingly, the minor variations in the vibrato shape will not diminish the listener's enjoyment of the performance.

Nonetheless, if distortion in the vibrato shape was a concern, the distortion could be reduced or eliminated with a more sophisticated correct size addition (depicted as step 180 in FIG. 1). For example, the correction step size at perceived peaks and valleys of the corrected finger position 310 could be adjusted to "smooth out" these locations. This may be implemented by considered additional past values of the corrected finger position 310. Alternatively, this may be implemented by considered additional past values of the actual finger position 300, or a combination of both. Such modifications could also increase the rate of convergence.

Alternatively, as noted above, the correction step could be adjusted by the musician during the performance. If a slower correction (and less potential for deformation of the vibrato shape), or a faster correction and increased potential for deformation of the vibrato shape is desired, the musician could move a foot pedal or other input device to introduce this change.

As shown in FIG. 4, the embodiment also allows for pitch correction with glissando. Actual finger position 400 starts off slightly flat and finishes slightly sharp. Corrected finger position 410 corrects these errors while maintaining a similar glissando shape.

Figure 5:
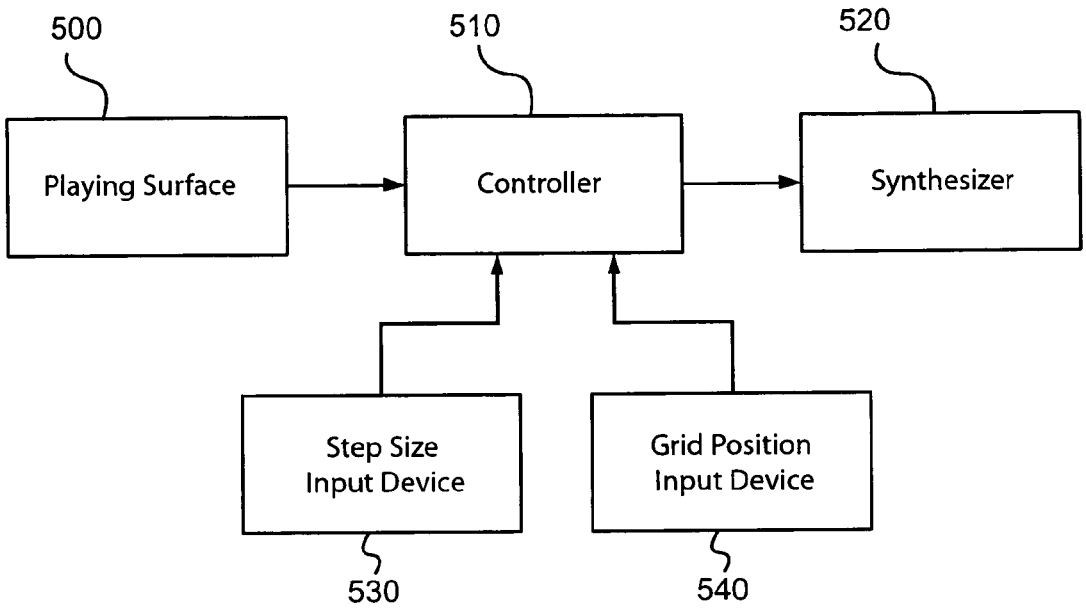
FIG. 5 is a block diagram of a system for correcting finger position data.

FIG. 5 is a block diagram of a system for correcting pitch. The playing surface 500 may be a continuous playing surface, such as the Haken Audio™ Continuum™ Fingerboard. Alternatively, the playing surface may be any input device in which a position among a spectrum (continuous or discrete) of positions is designated by a user.

Finger positions on the playing surface 500 are relayed to the controller 510. In one embodiment, the controller 510 calculates corrected finger position data, and encodes outputted pitch information into a data format, such as the MIDI format. In another embodiment, the controller 510 additionally provides the actual finger position data. In such an embodiment, the controller 510 may incorporate some or all of the processing features discussed in U.S. Pat. No. 6,703,522. For example, controller 510 may collect sensor values from the playing surface 500, the normalization of those values, and the determination of the Left-to-Right (X Value), Front-to-Back (Y value), and Position and Depth (Z value) the controller 510.

Although FIG. 5 depicts separate, single elements for the playing surface 500 and the controller 510, the elements of the playing surface 500 and the controller 510 may be encompassed in a single package. Alternatively, features performed by the controller 510 may be performed by a multiple controllers. The controller 510 or multiple controllers may operate either as stand-alone hardware or as software run by one or more microprocessors.

The synthesizer 520 receives the musical data from the controller 510 and uses the data to convert the signal into an audible audio signal. The synthesizer 520 may be an electronic instrument that uses sound generators to create complex waveforms. The generation of audible sound may be performed by wavetable synthesis, frequency modulation synthesis, or any other technique of generating audible sound from musical information, such as MIDI data. The synthesizer 520 may be encompassed in the same package as the playing surface 500 and/or controller 510, may be separately contained in a rack-mountable module, or may be incorporated into a computer sound card. The synthesizer 520 may output an audio signal to a pre-amplifier, amplifier, may include a pre-amplifier or amplifier, and/or may include headphone jack.

Also shown in FIG. 5, a step size input device 530 may be connected with the controller. The step size input device 530 may be connected via physical connection, a wireless connection, or through an intermediary. As discussed above, embodiments of the present invention may allow for adjustment of the correction step size. Accordingly, a step size input device 530 may be connected with the controller 510 to allow a musician to adjust the correction step size before, after, or even during a performance. In one embodiment, the step size input device 530 is a foot pedal. In other embodiments, the step size input device 530 may be a dial, button, slider, computer etc.

A grid position input device 540 may also be connected with the controller. Likewise, the grid position input device 540 may be connected via physical connection, a wireless connection, or through an intermediary. The grid position input device 540 allows a user to change the grid definition, and thus the grid positions. In one embodiment, the grid position input device 540 is a foot pedal. In other embodiments, the grid position input device 540 may be a dial, button, slider, computer etc.

The instructions for implementing the processes, methods and/or techniques discussed above may be provided on computer-readable storage media or memories, such as a cache, buffer, RAM, removable media, hard drive or other computer readable storage media. Computer readable storage media include various types of volatile and nonvolatile storage media. The functions, acts or tasks illustrated in the figures or described herein are executed in response to one or more sets of instructions stored in or on computer readable storage media. The functions, acts or tasks are independent of the particular type of instructions set, storage media, processor or processing strategy and may be performed by software, hardware, integrated circuits, filmware, micro code and the like, operating alone or in combination. Likewise, processing strategies may include multiprocessing, multitasking, parallel processing and the like. In one embodiment, the instructions are stored on reprogrammable firmware. Alternatively, the instructions may be stored on a removable media device for reading by local or remote systems. In other embodiments, the instructions are stored in a remote location for transfer through a computer network or over telephone lines. In yet other embodiments, the instructions are stored within a given computer, CPU, GPU or system.

While the invention has been described above by reference to various embodiments, it should be understood that many changes and modifications can be made without departing from the scope of the invention. For example, embodiments disclosed have been directed primarily to corrections of finger positions on a continuous playing surface. Nonetheless, the invention may be practiced with any playing surface, including a non-continuous playing surface. Further, the invention may be utilized to perform correction of positions that do not correspond to pitch values. If a finger position may translates to a range of values that can be represented into a grid, the methods and system may be utilized. For example, the Front-to-Back (Y direction) values may control different timbres which may be corrected.

It is therefore intended that the foregoing detailed description be regarded as illustrative rather than limiting, and that it be understood that it is the following claims, including all equivalents, that are intended to define the spirit and scope of this invention.

I claim:

1. A method for position correction in an electronic musical instrument, the method comprising the acts of:

(a) providing a plurality of grid positions and previous corrected finger position data;

(b) receiving current actual finger position data, the current actual finger position data corresponding to a current finger position on a playing surface;

(c) identifying a nearest grid position;

(d) applying a correction step to the previous corrected finger position data, the correction step having a correction step size;

(e) outputting current corrected finger position data; and (f) repeating acts (b), (c), (d), and (e);

wherein the correction step size is smaller than the distance between two adjacent grid positions and act (f) continues until the current corrected finger position data corresponds to a location within a correction step size of the nearest grid position.

2. The method of claim 1, further comprising the acts of;

providing previous actual finger position data;

computing a change in finger position between current actual finger position data and previous actual finger position data; and adding the change in finger position to the previously corrected finger position data; and wherein the previous corrected finger position is initialized by storing the value of a current finger position as the previous corrected finger position.

3. The method of claim 2 wherein the current corrected finger position data is set to equal the nearest grid position if the act of adding the change in finger position to the previously corrected finger position data yields results in a value that is already within a correction step of the nearest grid position.

4. The method of claim 2 wherein act (c), identifying the nearest grid position, further comprises identifying which grid position is closest to the current actual finger position, a prior actual finger position, a current corrected finger position, a prior corrected finger position, or to the result of the act of adding the change in finger position to the previously corrected finger position data.

5. The method of claim 1 wherein the plurality of grid positions correspond to musical pitches and the correction step size is less than ten cents.

6. The method of claim 1, further comprising the act of:

encoding the current corrected finger position data as a pitch in MIDI format.

7. The method of claim 1 wherein act (f) continues until the current corrected finger position data corresponds to a location within a correction step size of the nearest grid position or it is determined that a finger corresponding to the actual finger positions has been lifted from a playing surface.

8. The method of claim 1 wherein acts (a)-(f) are performed for multiple sets of previous corrected finger position data, current corrected finger position data, and current actual finger position data, the multiple sets corresponding to different finger positions simultaneously located on the playing surface.

9. A system for position correction for an electronic musical instrument, the system comprising:

a playing surface;

a plurality of grid positions corresponding to locations on the playing surface;

a controller connected with the playing surface, the controller operable to identify a finger position on the playing surface and adjust data corresponding to the finger position on the playing surface by mathematically moving the data toward a nearest grid position by applying a correction step, the correction step having a correction step size;

wherein the correction step size is smaller than the distance between two adjacent grid positions, the controller repeatedly moves the data toward a grid position until the data corresponding to the finger position is located within a correction step of a nearest grid position, and the nearest grid position is calculated with respect to the finger position for each application of a correction step.

10. The system of claim 9 wherein the controller is polyphonic.

11. The system of claim 9 wherein the playing surface is a continuous-pitch playing surface.

12. The system of claim 9 wherein the finger position corresponds to a musical pitch, the correction step size is less than 10 cents, and the controller outputs data corresponding to musical pitch.

13. The system of claim 9 wherein the controller outputs data in MIDI format.

14. The system of claim 9 further comprising:

a step size input device connected with the controller, the step size input device operable to input a desired correction step size to the controller.

15. The system of claim 14 wherein the step size input device is a foot pedal.

16. The system of claim 9 wherein the controller is operable to compute a change in finger position between a current actual finger position and a previous actual finger position, add the change in finger position to a previous corrected finger position, and apply a correction step to the summation of the change in finger position and the previously corrected finger position.

17. The system of claim 9 further comprising:

a grid position input device connected with the controller, the grid position input device operable to instruct a change in grid definition.

18. In a computer readable storage medium having stored therein data representing instructions executable by a programmed processor for electronic music controller, the storage medium comprising instructions for:

storing a set of grid positions;

storing a correction step size;

storing a plurality of corrected finger position values, the plurality comprising a current corrected finger position value and at least one previous corrected finger position value;

storing a plurality of actual finger position values, the plurality of actual finger position values comprising a current actual finger position and at least one previous actual finger position value;

calculating the difference between two actual finger position values;

adding the difference between the two actual finger position values to at least one previous corrected finger position value;

identifying the nearest grid position with respect to the current actual finger position, to the current corrected finger position value, to the at least one previous corrected finger position value, to the at least one previous actual finger position value, or to the result of adding the difference between two actual finger position values to at least one previous corrected finger position value, prior to each addition of a correction step;

adding a correction step in the direction of the nearest grid position to the summation of the difference between the two actual finger position values and the at least one previously corrected finger position; and storing a current corrected finger position value.

19. The computer readable storage medium of claim 18, further comprising the instructions for:

setting the current corrected finger position value to be the nearest grid value if the nearest grid position is within a correction step of a summation of the difference between two actual finger position values and at least one previous corrected finger position.

20. The computer readable storage medium of claim 18 wherein the set of grid values correspond to musical pitches and the correction step size is less than 10 cents.

21. The computer readable storage medium of claim 18, further comprising the instructions for concluding finger correction if it is determined that a finger that corresponds to a set of actual finger position values has been lifted from a playing surface.

22. The computer readable storage medium of claim 18, further comprising the instructions for changing the correction step size.

23. The computer readable storage medium of claim 18 further comprising instructions for producing polyphonic output.

* * * * *